United States Patent [19]

Ozaki

[11] Patent Number: 4,930,472

[45] Date of Patent: Jun. 5, 1990

[54] VEHICLE AIR CLEANER

[75] Inventor: Tadayuki Ozaki, Shizuoka, Japan

[73] Assignee: Suzuki Jidosha Kogyo Kabushiki Kaisha, Shizuoka, Japan

[21] Appl. No.: 348,307

[22] Filed: May 5, 1989

[30] Foreign Application Priority Data

May 23, 1988 [JP] Japan ..... 63-67906[U]

[51] Int. Cl.[5] ..... F02B 77/00

[52] U.S. Cl. ..... 123/198 E; 181/229; 55/276

[58] Field of Search ..... 123/198 E; 181/214, 181/229, 247, 255; 55/276, 418, 419, 497, 510, DIG. 21

[56] References Cited

U.S. PATENT DOCUMENTS

| | | | |
|---|---|---|---|
| 2,299,157 | 10/1942 | Lowther | 123/198 E |
| 3,835,956 | 9/1974 | Kishira | 181/229 |
| 4,006,724 | 2/1977 | Carter | 123/198 E |

FOREIGN PATENT DOCUMENTS

| | | | |
|---|---|---|---|
| 100256 | 5/1988 | Japan | 123/198 E |
| 806889 | 2/1981 | U.S.S.R. | 123/198 E |

*Primary Examiner*—Noah P. Kamen

*Attorney, Agent, or Firm*—Flynn, Thiel, Boutell & Tanis

[57] ABSTRACT

An air cleaner is provided in the air intake system for an internal combustion engine. An air intake port is provided at the inlet to the air cleaner. A suction air passage is provided in the air intake port and has a cross section that gradually decreases along the air flow direction.

6 Claims, 3 Drawing Sheets

VEHICLE AIR CLEANER

FIELD OF THE INVENTION

This invention relates to a vehicle air cleaner for cleaning the air supplied to an internal combustion engine.

BACKGROUND OF THE INVENTION

Dust in air directly taken into the cylinder of internal combustion engines accelerates abrasion of the cylinder and piston and contaminates the engine oil which causes the bearings to be quickly abraded. Therefore, the air cleaner is installed on the internal combustion engine to remove dust from air being fed to the engine. The air cleaner also has the functions of improving engine output, decreasing pulsatory noises due to operation of the intake throttle valve and air suction noises, including air current noises due to the turbulence of air flow, and controlling fuel supply by dampening the pulsating flow of the suction air.

The structure of an air cleaner having the above functions is disclosed in Japanese application No. 61-48966. This air cleaner is designed so that the cross section of the air-incoming chamber formed between the pre-filter element and the bottom wall of the bottom case gradually decreases from the entrance.

FIG. 3 shows the structure of another known air cleaner. The air cleaner 4 shown in FIG. 3 has a case 10 consisting of a bottom portion 6 having a suction air passage 20 formed at an intake port 18, and a top portion 8 having an outgoing air passage 32 for supplying clean air to an air feed pipe 34 connected to the internal combustion engine 2. A filter element 12 is installed in the case 10. The suction air passage 20 of the intake port 18 is also connected to an intake pipe 28 which forms an intake passage 26 for taking in air from the outside.

In the structure of existing air cleaners, however, air suction noises produced at the downstream side of the air cleaner 4 easily pass through the suction air passage 20 and are propagated to the intake passage 26 side (shown by the arrow R in FIG. 3) because the passage cross section D of the suction air passage 20 is the same for the upstream-side opening 22 and the downstream-side opening 24. Therefore, there are the disadvantages that noises increase inside and outside a vehicle and the flow of suction air pulsates.

SUMMARY OF THE INVENTION

A purpose of the present invention is to produce a vehicle air cleaner capable of preventing air suction noises as produced at the downstream side of the air cleaner from being propagated to the outside and thereby decreasing noises inside and outside the vehicle, minimizing suction air resistance to thereby smoothly supply air, and preventing suction air flow from pulsating. So that the above disadvantages will be removed, the intake port of the air cleaner case is provided with a suction air passage whose cross section gradually decreases along the air flow direction.

To accomplish the above purpose, the present invention has a suction air passage whose cross section gradually decreases along the air flow direction provided in the intake port of the vehicle air cleaner to clean the air supplied to the internal combustion engine.

The configuration of the inventive device makes it possible to prevent air suction noises produced at the downstream side of the air cleaner from being propagated to the outside through the suction air passage to decrease the noises inside and outside the vehicle, minimize the suction air resistance to thereby smoothly supply air, and prevent suction air flow from pulsating because the cross section of the suction air passage at the intake port gradually decreases along the air flow direction.

DETAILED DESCRIPTION

Figure 1:
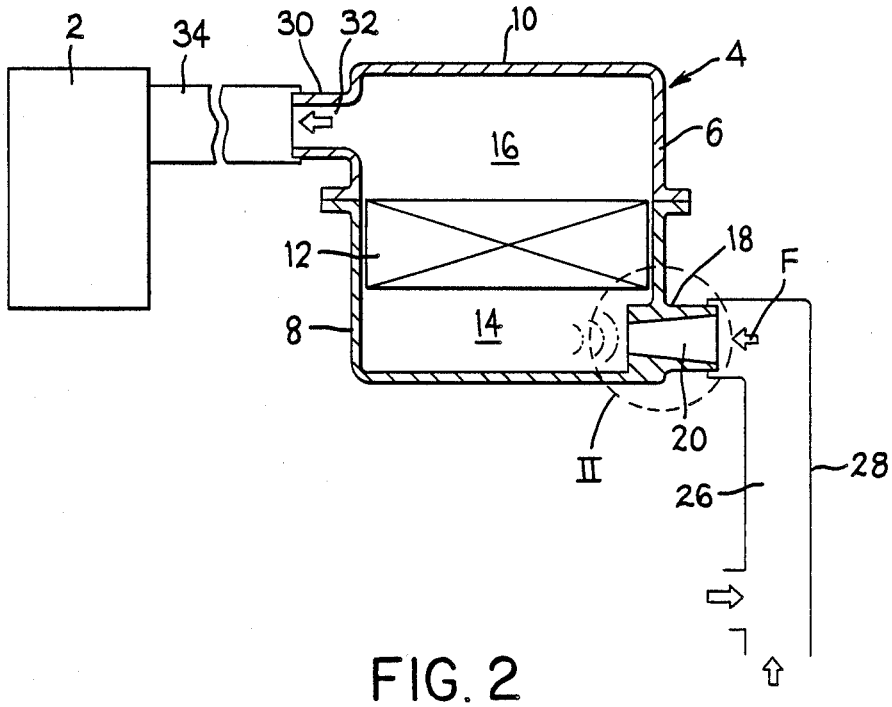
FIG. 1 schematically shows an internal combustion engine and an air cleaner according to the present invention.
Figure 2:
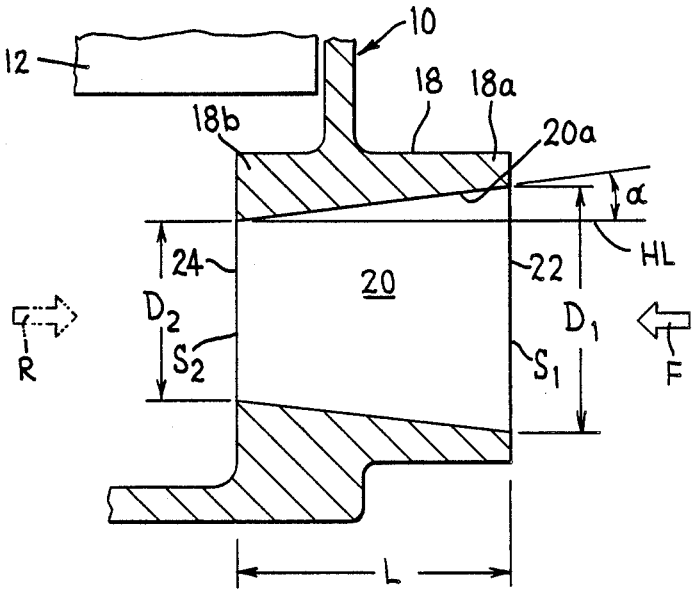
FIG. 2 shows an enlarged cross section of the intake port, as shown within the circle III in FIG. 1.
Figure 3:
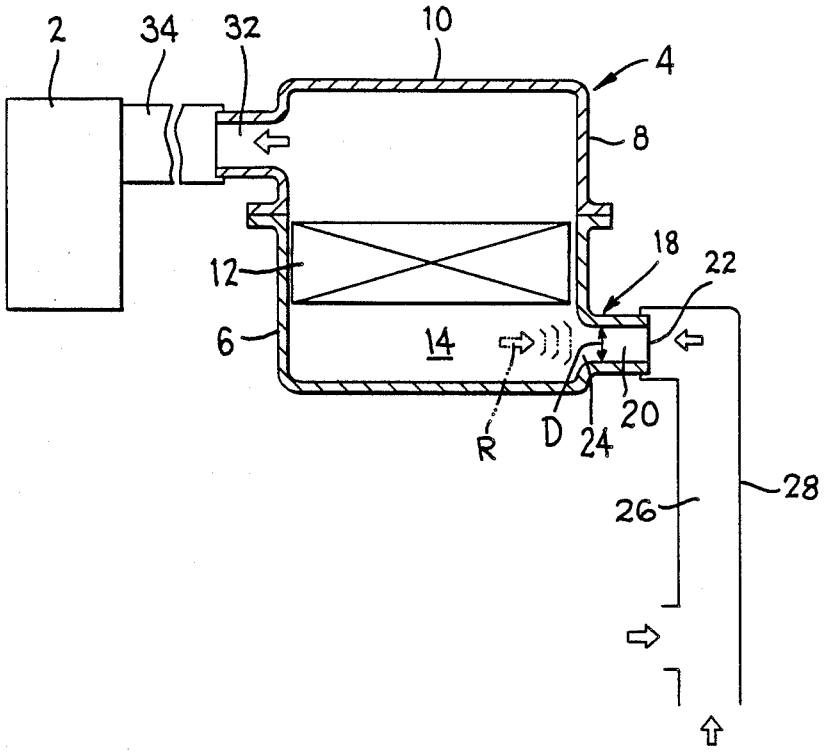
FIG. 3 PRIOR ART
FIG. 3 shows a known internal combustion engine and air cleaner.

FIGS. 1 and 2 show a preferred embodiment of the present invention. In the drawings, 2 represents the internal combustion engine as installed in a vehicle (not illustrated), and represents 4 the air cleaner installed in the intake system.

The air cleaner 4 has a housing or case 10 comprising a bottom portion 6 and a top portion 8 and a filter element 12 installed in the case 10. In the case 10, an incoming air chamber 14 defined in the bottom portion 6 and an outgoing air chamber 16 defined in the top portion 8 are separated by the filter element 12 therebetween.

The bottom portion 6 is equipped with a tubular intake port element 18. A suction air passage 20, through which air is introduced into the chamber 14, is formed through the intake port element 18. The suction air passage 20 is formed so that the cross section (i.e. area) gradually decreases along the incoming air flow direction F.

That is, the passage 20 is provided with an upstream-end opening 22 having a diameter D1 and a passage cross sectional area S1, this opening 22 being formed at the upstream-end **18*a* of the intake port element 18. Passage 20 is also provided with a downstream-end opening 24 having a diameter D2 smaller than D1 and a passage cross sectional area S2 smaller than S1, this opening 24 being formed at the downstream-end 18*b* of the intake port 18. The passage 20 has an axial length L as defined between the openings 22 and 24**.

The suction air passage 20 is conically tapered as it extends axially. That is the inside surface **20*a* as it extends between the upstream-end opening 22 and the downstream-end opening 24 is tilted or sloped at an angle $\alpha$ relative to the longitudinal centerline direction of the passage 20**, which longitudinal direction is normally horizontal and is represented by the line HL. The angle $\alpha$ is normally at least about 2 degrees relative to the direction HL, and is preferably in the range from about 2° to about 4°.

In the preferred embodiment of the invention, the length L of passage 20 and the diameter D1 of the inlet opening 22 are preferably about equal to one another, and hence the diameter D2 of the outlet opening 24 is smaller than the length L.

Thus, suction noises from the downstream side (shown by the arrow R in FIG. 2) of the air cleaner 4 are inhibited from easily passing backwardly (i.e. rightwardly) through the suction air passage 20, and the suction resistance of air flowing into the incoming air chamber 14 is minimized by gradually decreasing the cross sectional area of the suction air passage 20 along the air flow direction F.

Additionally, the intake port element 18 is connected with the intake pipe 28 which defines therein the intake passage 26 to take in air from the outside.

Meanwhile, at the top case portion 8, the outgoing air passage 32 is formed by the tubular air exit element 30 to supply the air cleaned by the filter element 12 to the internal combustion engine 2. The air exit element 30 connects with the hollow air feed pipe 34 which is coupled with the internal combustion engine 2.

The following describes the performance of the preferred embodiment:

Suction air, led by the intake passage 26, reaches the incoming air chamber 14 through the suction air passage 20 of the intake port element 18. The air in the incoming air chamber 14 is cleaned by the filter element 12 before it reaches the outgoing air chamber 16 and is supplied to the internal combustion engine 2 through the outgoing air passage 32 and the air feed pipe 34. Meanwhile, air suction noises, including air current noises due to turbulence of air flow, are produced by the internal combustion engine 2 at the downstream side of the air cleaner and are propagated to the suction air passage 20 and intake passage 26 through the incoming air chamber 14 (shown by the arrow R in FIG. 2).

In the preferred embodiment, however, because the downstream-end opening 24 of the suction air passage 20 has a smaller cross section S2, suction noises are inhibited from passing through the suction air passage 20 and thus are not propagated to the intake passage 26. Therefore, less suction noises are propagated to the outside, noises inside and outside the vehicle are reduced, and overall quietness is improved.

Additionally, because the passage cross section S1 of the upstream-end opening 22 of the suction air passage 20 is large, the suction resistance of the air incoming from the intake passage 26 to the incoming air chamber 14 is minimized and the suction air flow is prevented from pulsating. Therefore, the proper amount of air can be smoothly supplied to the internal combustion engine 2. Thus, the operation of the internal combustion engine 2 can be maintained in a good condition.

Figure 4:
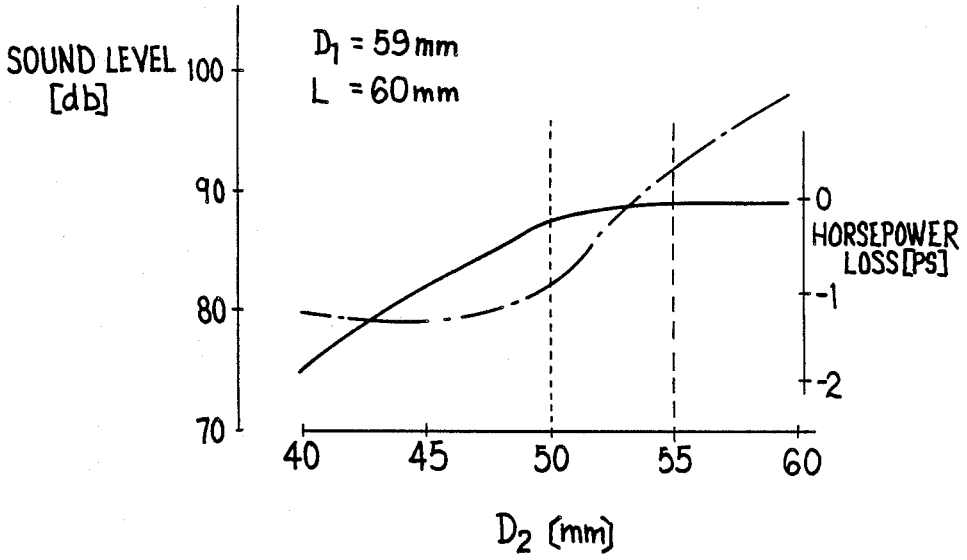
FIG. 4 is a chart which graphically depicts the improved performance of one embodiment of the present invention.

As an example of a preferred embodiment of the present invention, the diameter D1 is 59 mm, the length L is 60 mm, and the diameter D2 is about 50 mm to about 55 mm. Referring to FIG. 4, the performance of this invention, as it relates to sound level (chain line) and horsepower loss (solid line), is graphically shown, and indicates the preferred range of diameter D2 for the stated D1 and L dimensions. Of course, if the length L is changed, then the diameters D1 and D2 will also be proportionally changed.

As shown in the above detailed explanation, the present invention makes it possible to prevent the suction noises produced at the downstream side of the air cleaner from being propagated to the outside and thereby reduces the noises inside and outside a vehicle, minimizes the suction resistance of the air into the air cleaner so as to smoothly supply air to the internal combustion engine, and prevents the suction air flow from pulsating, by the installation of a suction air inlet passage whose cross section gradually decreases along the normal air flow direction.

What is claimed is:

1. A vehicle air cleaner installed in an air intake system so that air can be supplied to an internal combustion engine, comprising an air cleaner housing having a tubular air inlet port element fixed thereto, said air inlet port element having a suction air passage extending therethrough for communication with an incoming air chamber defined within the housing, said suction air passage having a cross section that gradually decreases along the air flow direction, said suction air passage having a diameter at an inlet end thereof and having an axial length approximately equal to said diameter.

2. In an internal combustion engine having an air intake system for introducing air thereinto, said air intake system including an air cleaner housing having an air intake port installed therein, the improvement wherein said air intake port includes a suction air passage having a cross section that generally decreases along the air flow direction, said suction air passage having a diameter at an inlet end thereof and having an axial length approximately equal to said diameter.

3. In a vehicle air cleaner for supplying air to an internal combustion engine, said air cleaner including a hollow casing defining therein incoming and outgoing air chambers separated by a filter element, an exhaust port communicating with said outgoing air chamber, and a suction air passage communicating with said incoming air chamber, the improvement comprising a tubular inlet air port element fixed to said casing and defining said suction air passage therethrough for communication with said incoming air chamber, said suction air passage as defined within said element being axially elongated and of a gradually decreasing cross sectional area as the passage extends axially along the incoming air flow direction, said suction air passage having a first diameter at an inlet end thereof, and having an axial length which is about equal to said first diameter.

4. An air cleaner according to claim 3, wherein said suction air passage is of a second diameter at a discharge end thereof, said second diameter being smaller than said first diameter, and said passage being defined by a generally truncated conical wall which extends between said first inlet end and said discharge end.

5. An air cleaner according to claim 4, wherein said conical wall extends at a slope of at least about 2° relative to the longitudinally extending centerline of the passage.

6. An air cleaner according to claim 3, wherein said passage is defined by a wall which extends at a slope of between about 2° to about 4° relative to the longitudinally extending centerline of the passage as the wall extends in the incoming air flow direction.

* * * * *

UNITED STATES PATENT AND TRADEMARK OFFICE

CERTIFICATE OF CORRECTION

PATENT NO. : 4 930 472

DATED : June 5, 1990

INVENTOR(S) : Tadayuki OZAKI

It is certified that error appears in the above-identified patent and that said Letters Patent is hereby corrected as shown below:

Column 4, line 25; change "generally" to ---gradually---.

Column 4, line 51; delete "first".

Signed and Sealed this

Seventeenth Day of December, 1991

*Attest:*

HARRY F. MANBECK, JR.

*Attesting Officer*

*Commissioner of Patents and Trademarks*